US007677416B2

(12) United States Patent
Foster et al.

(10) Patent No.: US 7,677,416 B2
(45) Date of Patent: Mar. 16, 2010

(54) IN-LINE MANUALLY OPERATED LIQUID DISPENSER WITH SIMPLIFIED CONSTRUCTION

(75) Inventors: Donald D. Foster, St. Charles, MO (US); Jeffrey P. Stark, Wentzville, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 1177 days.

(21) Appl. No.: 10/620,043

(22) Filed: Jul. 15, 2003

(65) Prior Publication Data

US 2005/0011913 A1 Jan. 20, 2005

(51) Int. Cl.
*B65D 37/00* (2006.01)
*B65D 88/54* (2006.01)
*B67D 5/40* (2006.01)

(52) U.S. Cl. ..... 222/209; 222/321.8; 222/383.3

(58) Field of Classification Search ..... 222/206–215, 222/383.1–385, 321.7, 321.8
See application file for complete search history.

(56) References Cited

U.S. PATENT DOCUMENTS 4,138,039 A * 2/1979 Micallef ..... 222/207
4,159,067 A * 6/1979 Akers ..... 222/153.02
4,452,379 A * 6/1984 Bundschuh ..... 222/207
4,589,573 A * 5/1986 Tada ..... 222/153.13
5,518,147 A * 5/1996 Peterson et al. ..... 222/153.07
5,816,453 A * 10/1998 Spencer et al. ..... 222/321.3

* cited by examiner

*Primary Examiner*—Kevin P Shaver
*Assistant Examiner*—Melvin A Cartagena

(57) ABSTRACT

A hand operated liquid dispenser has a simplified, in-line construction that reduces the number of component parts of the dispenser and thereby reduces the dispenser's manufacturing costs. The in-line construction of the liquid dispenser coaxially aligns a liquid discharge orifice, a liquid discharge passage, and a pump chamber of the dispenser. The construction provides a compact liquid dispenser that can be easily held in one hand by a user and manipulated by the fingers of the user's hand to pump liquid from a bottle attached to the liquid dispenser and dispense the liquid in a variety of different discharge patterns.

19 Claims, 6 Drawing Sheets

IN-LINE MANUALLY OPERATED LIQUID DISPENSER WITH SIMPLIFIED CONSTRUCTION

BACKGROUND OF THE INVENTION (1). Field of the Invention

The present invention pertains to a low cost construction of a hand held and hand operated liquid dispenser. In particular, the present invention pertains to a hand operated liquid dispenser of simplified construction that reduces the number of component parts of the dispenser and thereby reduces the dispenser's manufacturing cost. The dispenser's simplified construction provides a dispenser having a pump plunger that is manually reciprocated along a straight line of movement to operate a pump and dispense liquid from the dispenser. A liquid discharge passage extends through the pump plunger and communicates the pump with a liquid discharge orifice on the pump plunger. The liquid discharge orifice dispenses liquid from the liquid dispenser in a desired discharge pattern that is directed along the line of reciprocating movement of the pump plunger.

(2). Description of the Related Art

Hand held and hand operated liquid sprayers are well known in the liquid sprayer art. Typically known as trigger sprayers, these sprayers are commonly used to dispense household cleaning or cooking liquids in a stream or spray pattern or as a foam. A trigger sprayer is typically connected to a plastic bottle containing the liquid dispensed by the trigger sprayer.

A typical trigger sprayer is comprised of a sprayer housing that is connected to a neck of the bottle of liquid by a threaded connection or a bayonet-type connection. The sprayer housing is formed with a pump chamber, a vent chamber, a liquid discharge passage, and a liquid supply passage. The liquid discharge passage communicates the pump chamber with an outlet orifice of the trigger sprayer. The liquid discharge passage often contains a liquid spinner. The liquid supply passage communicates the pump chamber with a dip tube that extends into the liquid in the bottle when the trigger sprayer housing is attached to the bottle neck.

A pump piston is mounted in the pump chamber for reciprocating movement of the piston through the chamber. The pump piston moves in a direction out of the pump chamber to increase the interior volume of the pump chamber. This movement of the piston draws liquid through the dip tube and the liquid supply passage and into the pump chamber. The pump piston moves in a direction into the pump chamber to decrease the interior volume of the pump chamber. This movement of the piston pumps liquid from the pump chamber through the liquid discharge passage and out of the trigger sprayer. A spring is provided in the pump chamber for biasing the pump piston in the direction out of the pump chamber.

A vent piston is connected to the pump piston. The vent piston is received in the vent chamber for reciprocating movement between opened and closed positions of the vent piston in the vent chamber. In the opened position of the vent piston, the interior of the bottle attached to the trigger sprayer is allowed to vent through the vent chamber to the exterior environment of the trigger sprayer. In the closed position of the vent piston, the interior of the bottle is closed to the exterior environment preventing unintended leakage of the liquid contents of the bottle through the vent chamber to the trigger sprayer exterior environment.

A trigger is mounted on the sprayer housing by a pivot connection. The trigger is also connected to the pump piston and the vent piston. Repeating the sequence of manually squeezing the trigger toward the sprayer housing against the bias of the pump chamber spring, and then releasing the trigger oscillates or pivots the trigger about its pivot connection. The pivoting movement of the trigger reciprocates the pump piston in the pump chamber and reciprocates the vent piston in the vent chamber.

A pair of check valves or one-way valves are assembled in the sprayer housing to control the flow of liquid through the liquid supply passage, the pump chamber, and the liquid discharge passage. One of the check valves is positioned between the liquid supply passage and the pump chamber. This check valve controls the flow of liquid through the dip tube and the liquid supply passage to the pump chamber, and prevents the reverse flow of liquid. A second of the check valves is positioned between the pump chamber and the liquid discharge passage. This second check valve controls the flow of liquid from the pump chamber through the liquid discharge passage, and prevents the reverse flow of liquid.

A nozzle assembly having a liquid discharge orifice is assembled to the sprayer housing at the outlet of the liquid discharge passage. The liquid spinner in the liquid discharge passage has a liquid swirl chamber at an end of the spinner. The swirl chamber imparts a spin to the liquid pumped through the liquid discharge passage just prior to the liquid being discharged through the liquid discharge orifice of the nozzle. The nozzle of many trigger sprayers can adjust the pattern of liquid discharge from the trigger sprayer by rotating the nozzle relative to the sprayer housing. The nozzle can often be rotated between an off position where liquid discharge from the trigger sprayer is prevented, to a spray position where liquid is discharged from the trigger sprayer in a spray pattern, to a stream position where liquid is discharged from the trigger sprayer in a stream pattern, to a foam position where liquid is discharged from the trigger sprayer as a foam, or any combination of these liquid discharge patterns.

From the manual oscillating movement of the trigger on the sprayer housing, the pump piston is reciprocated in the pump chamber. This results in liquid being drawn from the bottle through the dip tube and past the first check valve to the pump chamber. The liquid is then pumped from the pump chamber past the second check valve and through the liquid discharge passage. The liquid passes through the liquid spinner and the liquid discharge orifice of the nozzle and is dispensed from the trigger sprayer.

The typical trigger sprayer described above has many separate component parts. The manufacturing of each of these separate component parts and their assembly into the trigger sprayer contributes to the overall manufacturing cost of the trigger sprayer. Because the typical trigger sprayer is manufactured and sold in very large numbers, even the slightest reduction in the manufacturing cost of a trigger sprayer design can result in a significant overall reduction in the cost of manufacturing large numbers of trigger sprayers. Thus, it is desirable to reduce the number of separate component parts of a manually operated liquid dispenser to reduce its manufacturing costs.

SUMMARY OF THE INVENTION

The manually operated liquid dispenser of the present invention reduces manufacturing costs by reducing the number of separate component parts that are assembled into the liquid dispenser. The liquid dispenser consists of only five component parts that are each constructed of a resilient plastic material. The liquid dispenser, being assembled from a reduced number of component parts than the conventional prior art trigger sprayer, results in reduced manufacturing costs for the liquid dispenser. In addition, the liquid dispenser has a novel, in-line construction in which several of the primary component parts of the liquid dispenser are aligned with a center axis of the dispenser pump chamber.

The liquid dispenser has a dispenser housing that contains a pump chamber, a vent chamber, and a liquid supply passage. The dispenser housing has an integral connector cap that attaches the liquid dispenser to a separate bottle containing a liquid to be dispensed by the dispenser. Unlike prior art trigger sprayers, the dispenser housing does not include a liquid discharge passage. The dispenser housing also differs from prior art trigger sprayer housings in that the front of the dispenser housing is left open, exposing an interior volume of the dispenser housing that surrounds the pump chamber and the vent chamber. In addition, the back or rearward end of the dispenser housing is provided with a hand engagement surface that is designed to comfortably fit a user's hand between the thumb and forefinger of the hand.

A flexible, resilient bulb is mounted to the pump chamber of the dispenser housing. The bulb can be flexed into the interior of the pump chamber to dispense liquid from the pump chamber, and the resiliency of the bulb pushes the bulb outwardly away from the pump chamber to draw liquid into the pump chamber. The bulb is formed with an integral, flexible tube input valve that controls the flow of liquid through the dip tube and the liquid supply passage into the pump chamber. The bulb is also formed with an integral, flexible tube output valve that controls the flow of liquid out of the pump chamber. Still further, the bulb is formed with an integral vent valve that seats over the vent chamber to prevent liquid in the bottle from leaking from the liquid dispenser through the vent chamber. The vent valve unseats from the vent chamber to vent the interior of the bottle when the bulb is flexed into the pump chamber of the dispenser housing.

A pump plunger is received in the front opening of the dispenser housing for reciprocating, telescoping movement of the pump plunger relative to the dispenser housing. The pump plunger has a finger engagement surface on a side of the liquid dispenser that is opposite the hand engagement surface of the dispenser housing. The finger engagement surface is positioned on the liquid dispenser where it will be engaged by the fingers of a user's hand holding the liquid dispenser. A liquid discharge passage extends through the pump plunger and communicates with the pump chamber through the output valve of the bulb.

A nozzle having a liquid discharge orifice is mounted on the pump plunger. The nozzle projects outwardly from the pump plunger finger engagement surface. The nozzle can be constructed as any conventional trigger sprayer nozzle, providing a combination of off, spray, stream and/or foam conditions to the liquid dispensed by the liquid dispenser.

A center axis of the nozzle liquid discharge orifice, a center axis of the pump plunger liquid discharge passage, and a center axis of the dispenser housing pump chamber are all coaxial. The center axes of the liquid discharge orifice, the liquid discharge passage, and the pump chamber also define a straight line of movement along which the pump plunger reciprocates relative to the dispenser housing when manually manipulated by a user's hand.

The resiliency of the bulb functions as a spring that resists the movement of the pump plunger along the line of movement into the interior volume of the dispenser housing. The resiliency of the bulb also moves the pump plunger away from the dispenser housing pump chamber when the finger engagement surface of the pump plunger is released by the user's hand. Thus, the bulb functioning as a spring that biases the pump plunger away from the dispenser housing eliminates the spring required by prior art trigger sprayers. In addition, the input valve, output valve and vent valve being integrally formed on the bulb reduces the number of component parts of the liquid dispenser of the invention from that of prior art trigger sprayers. This results in a reduction in the manufacturing cost of the liquid dispenser.

Furthermore, the pump plunger being easily manually reciprocated relative to the dispenser housing along the line of movement that is coaxial with the axes of liquid discharge orifice, the liquid discharge passage and the pump chamber results in a simplified construction of the liquid dispenser that is easily held and manually manipulated by a user's hand.

BRIEF DESCRIPTION OF THE DRAWINGS

Further features of the invention are set forth in the following detailed description of the preferred embodiment of the invention and in the drawing figures wherein.

DETAILED DESCRIPTION OF THE PREFERRED EMBODIMENT

Figure 1:
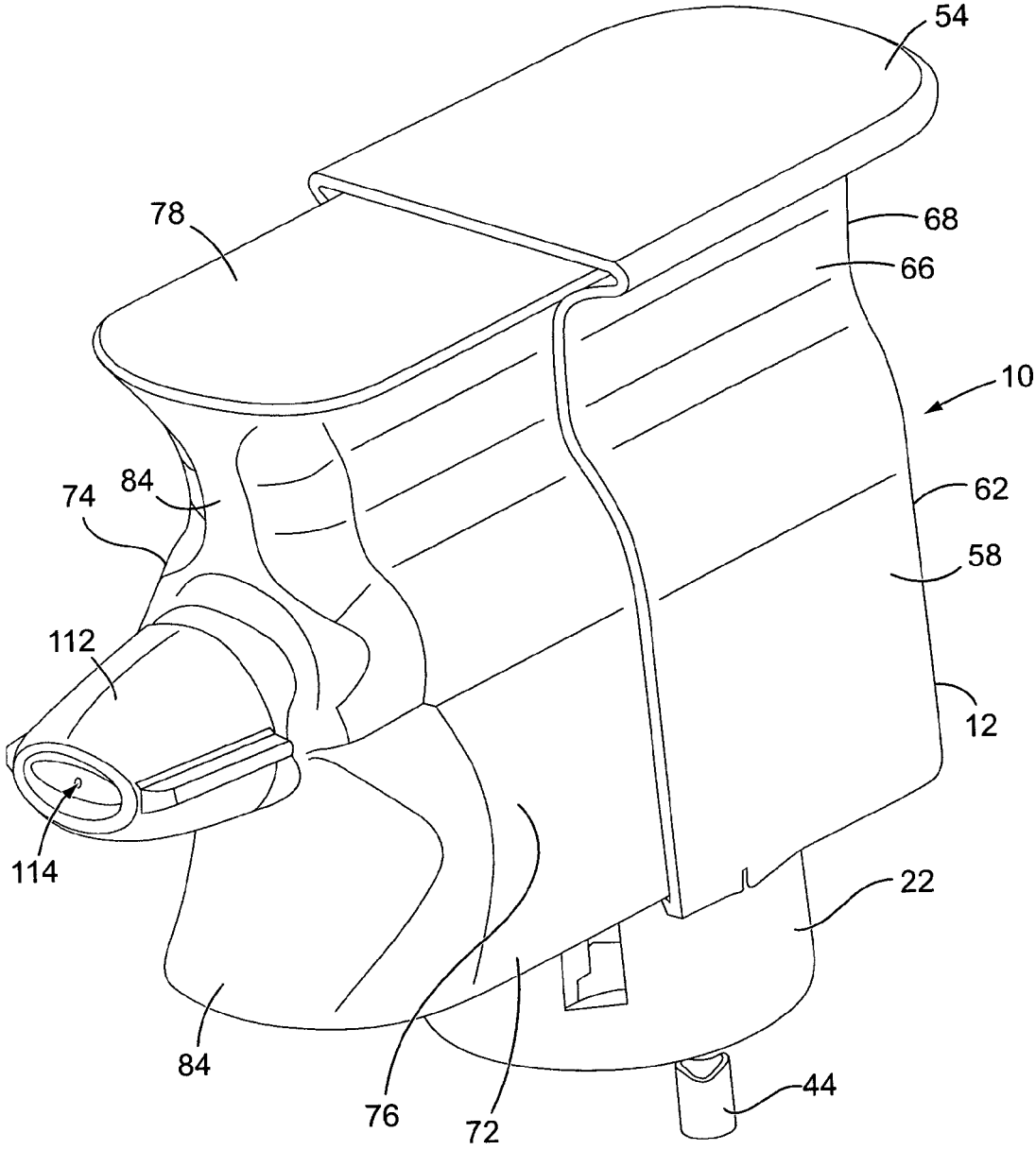
FIG. 1 is a front perspective view of the liquid dispenser of the invention.
Figure 2:
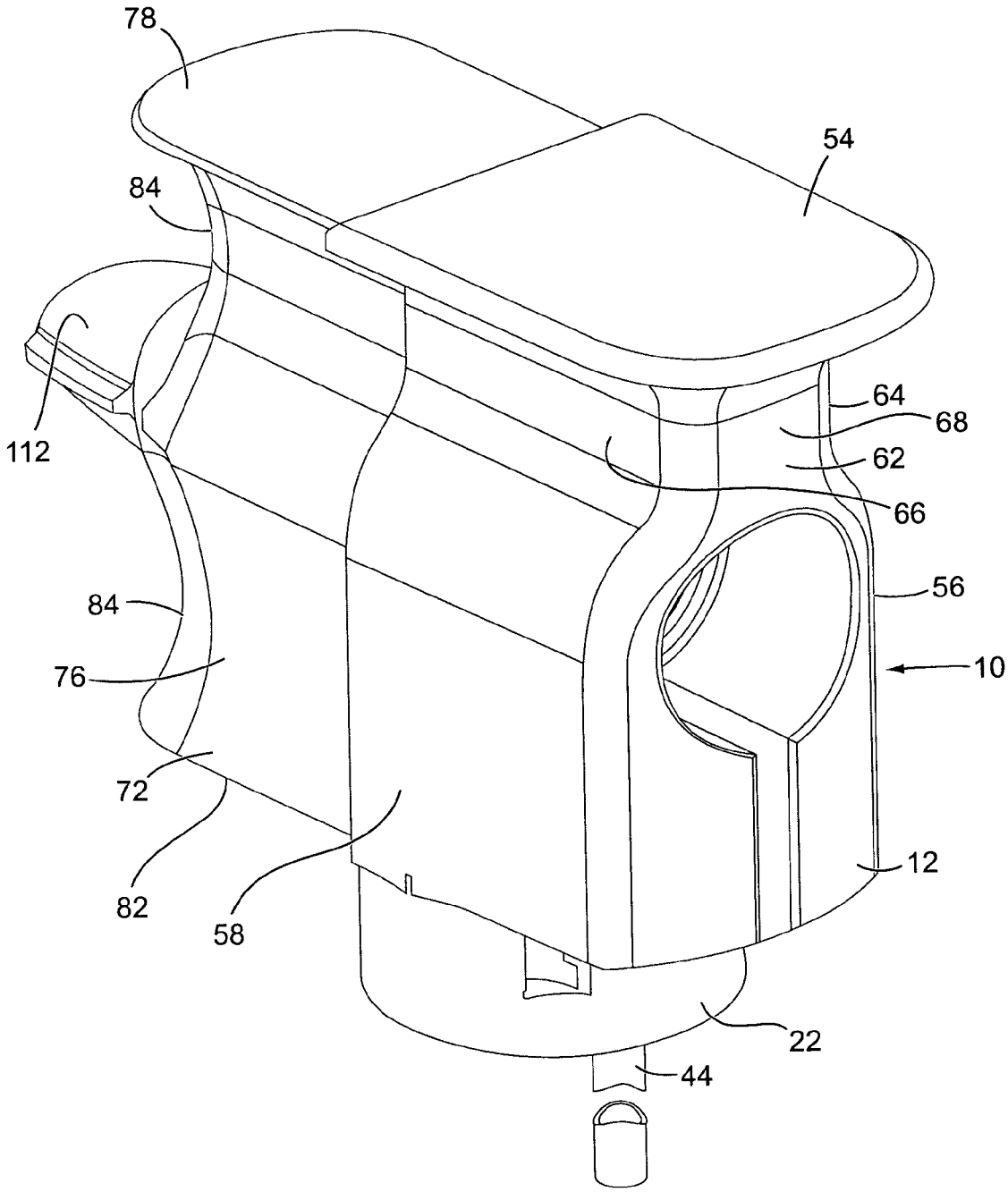
FIG. 2 is a rear perspective view of the liquid dispenser.

The in-line liquid dispenser 10 of the invention is constructed of only five separate component parts. Each of these component parts is constructed of a plastic material. The reduced number of component parts results in reduced manufacturing costs for the liquid dispenser. Several of the primary component parts of the liquid dispenser are positioned in a novel, in-line construction where the component parts are aligned with a center axis of the liquid dispenser pump chamber. This novel, in-line construction of the liquid dispenser also enables it to be constructed from a reduced number of component parts.

The liquid dispenser includes a dispenser housing 12 that is formed with an pump chamber 14, a vent chamber 16, a liquid supply passage 18, and a connector cap 22. Each of these structural features of the liquid dispenser are integrally molded as one piece with the dispenser housing 12.

The connector cap 22 is provided with a bayonet-type connector 24 in its interior. The bayonet-type connector 24 is employed in removably attaching the liquid dispenser to the neck of a separate bottle containing a liquid to be dispensed by the liquid dispenser. Bayonet-type connectors are well-known in the prior art. As an alternative to the bayonet-type connector, the connector cap 22 could also be provided with internal screw threading designed to mate with screw threading on the bottle neck.

Figure 4:
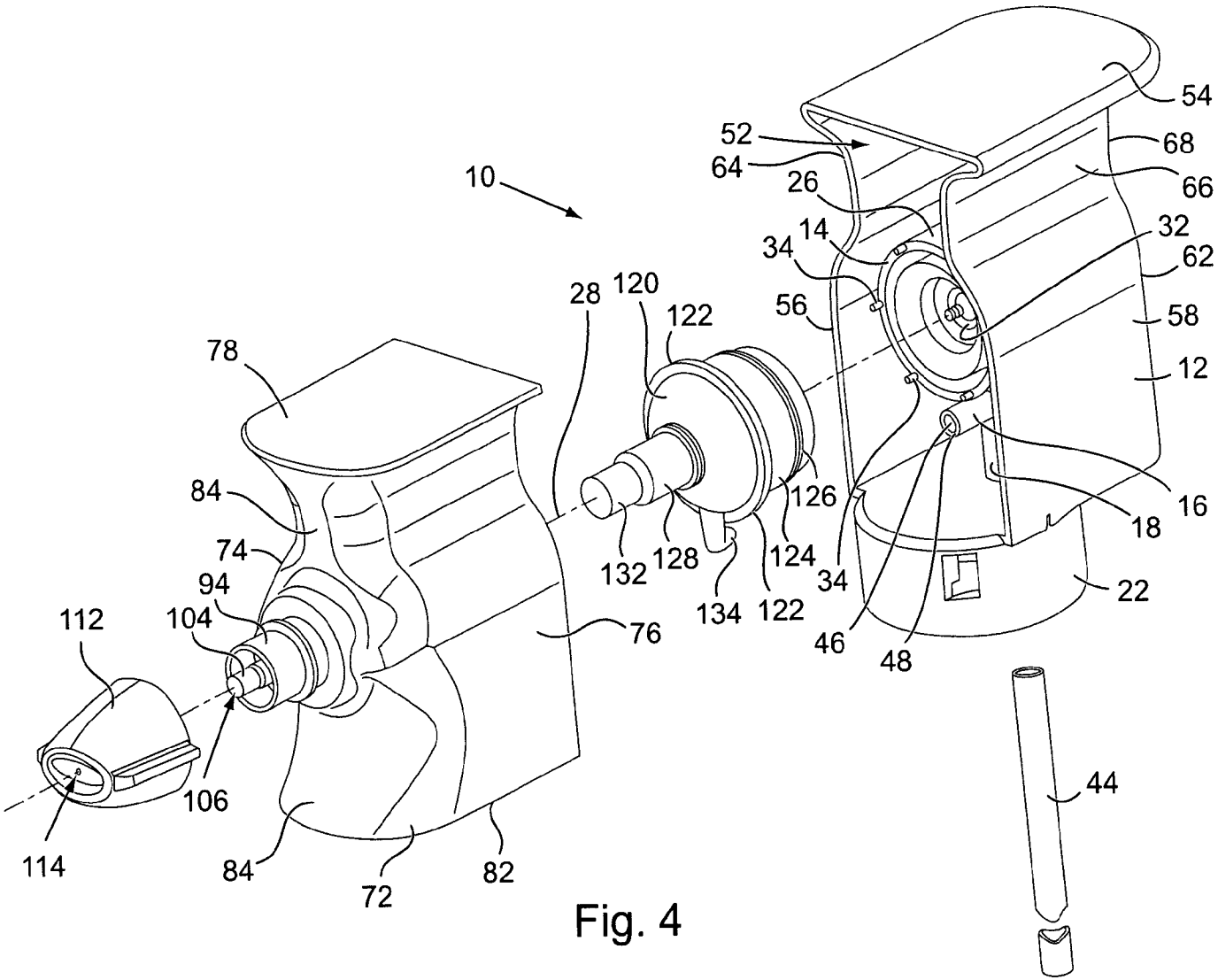
FIG. 4 is a front view of the dissembled component parts of the liquid dispenser.
Figure 5:
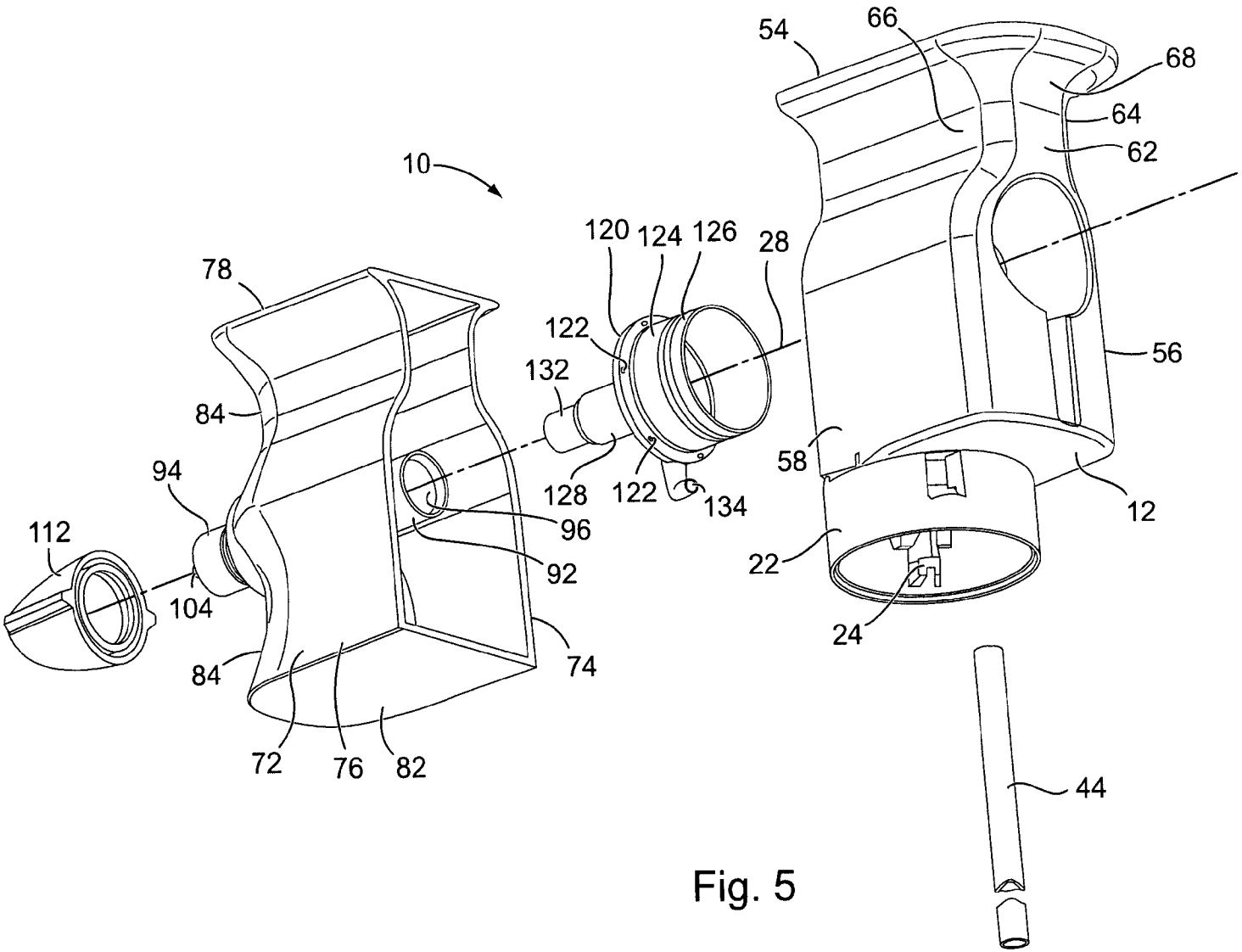
FIG. 5 is a rear view of the dissembled components parts of the liquid dispenser; and, FIG. 6 is a side, sectioned view of the component parts of the liquid dispenser.

The pump chamber 14 is formed by a cylindrical wall 26 having a cylindrical interior surface and a center axis 28. The back of the pump chamber 14 is closed by a rear wall 32. The front of the pump chamber's cylindrical wall is left open. A plurality of posts 34 project outwardly from the forward edge of the pump chamber's cylindrical wall 26 as shown in FIG. 4. The posts 34 are employed in securing a resilient bulb to the pump chamber cylindrical wall, which will be described later. A small input port 36 passes through a portion of the pump chamber's cylindrical wall 26 and communicates the pump chamber 14 with the liquid supply passage 18.

Figure 6:
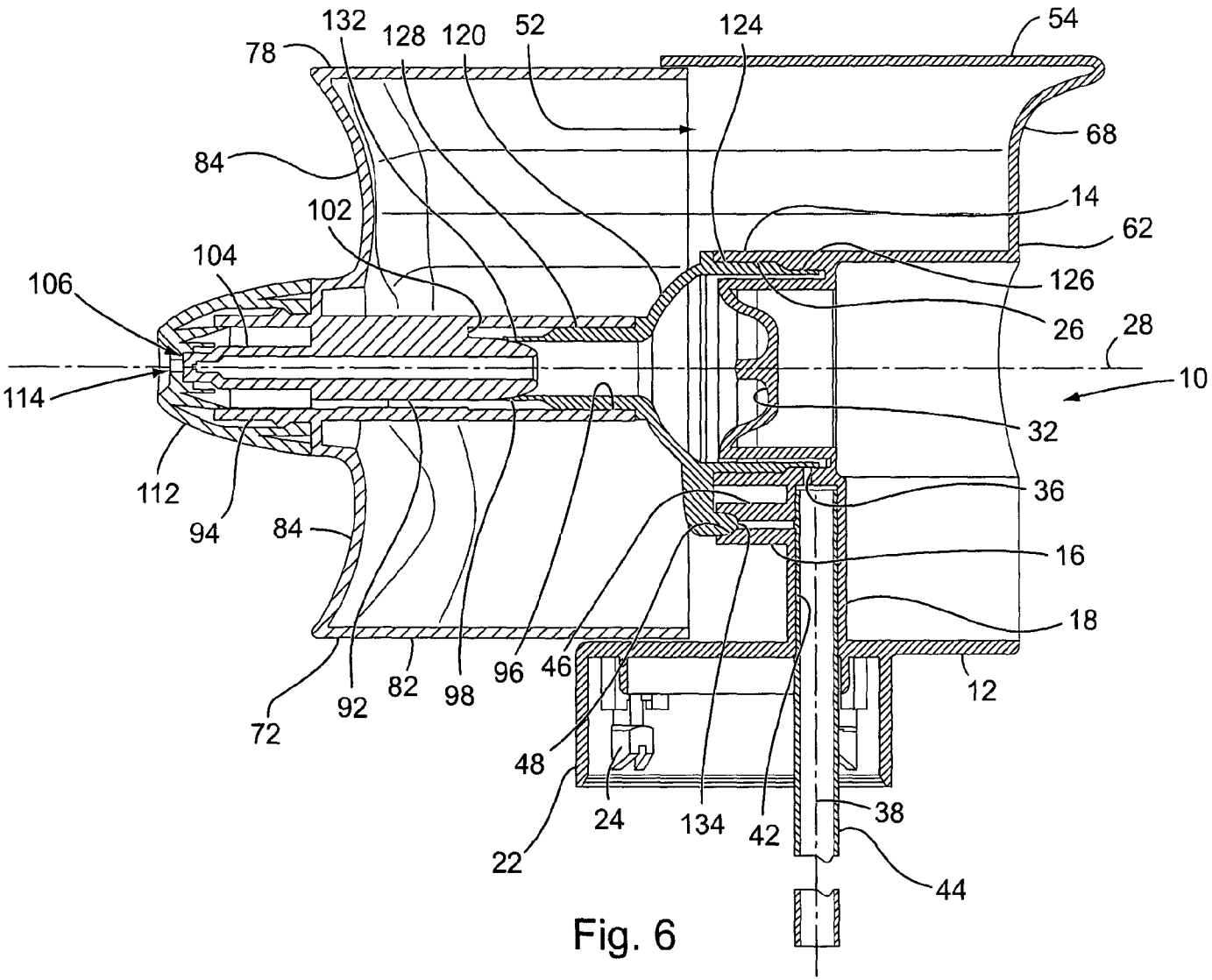

The liquid supply passage 18 has a cylindrical interior surface and a center axis 38. As shown in FIG. 6, the liquid supply passage center axis 38 is oriented at an angle, specifically a right angle, relative to the pump chamber center axis 28. The liquid supply passage 18 extends downwardly through the dispenser housing 12 from the pump chamber input port 36 through the bottom of the dispenser housing 12 inside the connector cap 22. A small axial groove 42 is recessed into the interior surface of the liquid supply passage 18 and extends along the length of the passage.

A dip tube 44 is inserted into the liquid supply passage 18 and forms a part of the length of the liquid supply passage. The dip tube 44 does not obstruct the axial groove 42 in the interior surface of the liquid supply passage 18. The dip tube 44 and liquid supply passage 18 communicate the interior of the pump chamber 14 through the pump chamber input port 36 with the liquid contents of a bottle attached to the liquid dispenser.

The vent chamber 16 is formed as a small cylindrical chamber having an interior passage 46 that communicates with the liquid supply passage 18 at one end and is open at its opposite end. The vent chamber is formed with a sealing surface 48 at its open end. The vent chamber interior passage 46 communicates with the interior of a bottle connected to the liquid dispenser through the axial groove 42 formed in the interior surface of the liquid supply passage 18.

The front of the dispenser housing 12 has a large opening exposing an interior volume 52 of the dispenser housing that surrounds the pump chamber 14, the vent chamber 16, and the liquid supply passage 18. The dispenser housing interior volume 52 is bounded by the connector cap 22 at the bottom, a top wall 54 of the dispenser housing at the top, and an opposite pair of side walls 56, 58 and a rear wall 62 of the dispenser housing.

As shown in the drawing figures, as the dispenser housing side walls 56, 58 extend upwardly from the connector cap 22 they taper inwardly toward each other and then taper outwardly away from each other to where they merge with the dispenser housing top wall 54. This forms notches or recessed areas 64, 66 in the respective side walls 56, 58 just beneath the dispenser housing top wall 54. These recessed areas 64, 66 in the dispenser housing side walls 56, 58 are provided to comfortably receive the thumb and forefinger of a user's hand holding the liquid dispenser. As the dispenser housing rear wall 62 extends upwardly from the connector cap 22 it curves gradually outwardly until it merges with the dispenser housing top wall 54 at the rear of the dispenser housing. The notches or recessed areas 64, 66 of the dispenser housing side walls and the area 68 of the dispenser housing rear wall 62 just beneath the top wall 54 form hand engagement surfaces. These hand engagement surfaces are designed to be received between the thumb and forefinger of a user's hand providing a comfortable grip on the dispenser housing 12 for the user's hand. In addition, the top wall 54 projecting outwardly over the recessed areas 64, 66 of the dispenser housing side walls and the rear wall portion 68 below the top wall 54 enables the top wall to rest comfortably on the thumb and forefinger of a user's hand holding the dispenser housing 12 to comfortably suspend the housing in the user's hand.

Figure 3:
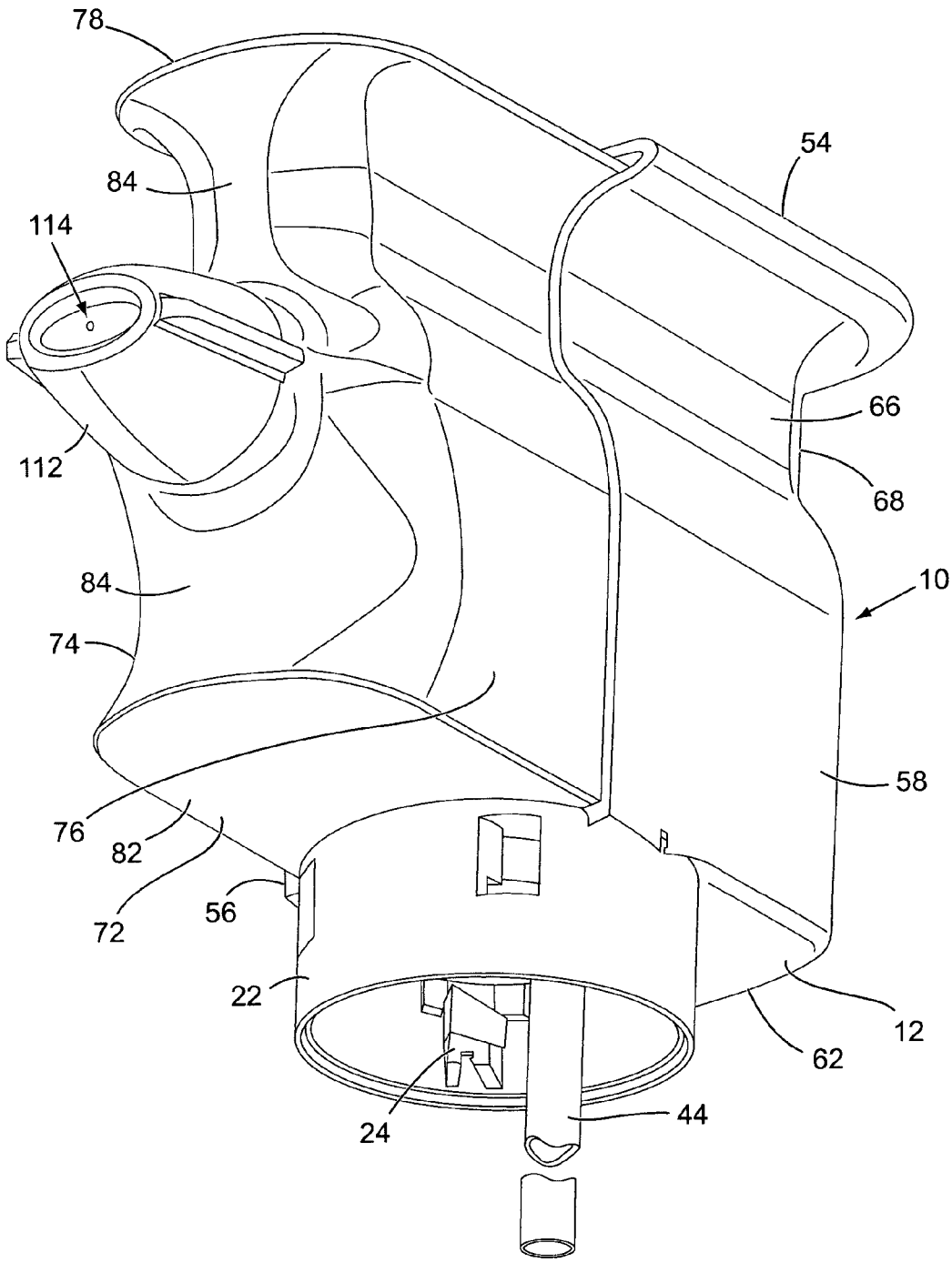
FIG. 3 is a front perspective view from beneath the liquid dispenser.

The liquid dispenser also comprises a pump plunger 72. The pump plunger 72 has a pair of opposite side walls 74, 76, a top wall 78, and a bottom 82 that are dimensioned and shaped to be received and to slide in a telescoping movement inside the respective side walls 56, 58, top wall 54 and above the connector cap 22 of the dispenser housing 12. As best seen in FIGS. 1 and 3, the configurations of the pump plunger side walls 74, 76 closely match those of the respective dispenser housing side walls 56, 58 enabling the pump plunger 72 to move in a sliding, telescoping movement into and out of the dispenser housing interior volume 52 through the front opening of the dispenser housing. The close conformance between the pump plunger side walls 74, 76, top wall 78, and bottom wall 82 to the interior surfaces of the respective dispenser housing side walls 56, 58, top wall 54 and the connector cap 22 causes the pump plunger 72 to reciprocate into and out of the dispenser housing interior volume 52 along a straight line of movement that is coaxial with the pump chamber center axis 28.

As the two side walls 74, 76 of the pump plunger 72 extend forward, they curve toward each other and merge with each other forming a finger engagement surface 84 at the front of the pump plunger. The finger engagement surface 84 curves inwardly into the pump plunger 72 as it extends downwardly from the pump plunger top wall 78 and upwardly from the pump plunger bottom wall 82. This causes the pump plunger top wall 78 and pump plunger bottom wall 82 to direct the fingers of a user's hand toward the center of the finger engagement surface 84, thus preventing the fingers of the user's hand from unintentionally becoming disengaged from the engagement surface when the liquid dispenser is in use. The convex configuration of the finger engagement surface 84 between the pump plunger side walls 74, 76 comfortably fits the curved configuration of the fingers of a user's hand gripping the liquid dispenser.

The pump plunger 72 has a center tube 92 that extends through the interior of the pump plunger. An outer portion of the tube 94 projects outwardly from the pump plunger finger engagement surface 84. The pump plunger tube 92 has a cylindrical interior surface 96 that defines a liquid discharge passage that passes through the length of the tube. The center tube liquid discharge passage has a center axis that is coaxial with the line of movement of the pump plunger 72 and is coaxial with the center axis 28 of the pump chamber 14. A sealing post 98 is centered in the liquid discharge passage by a plurality of webs 102 that radiate outwardly from the post to the pump plunger tube interior surface 96. The webs 102, only one of which is visible in FIG. 6, are spatially arranged around the sealing post 98 and center the sealing post in the liquid discharge passage without obstructing the flow of liquid through the passage. A liquid spinner 104 projects in the downstream direction from the opposite end of the sealing post 98. The liquid spinner 104 is formed with a swirl chamber in its distal end 106. The construction of the liquid spinner and the swirl chambers is known in the art and is not described in detail.

A nozzle 112 is mounted for rotation on the outer portion 94 of the pump plunger center tube. The nozzle 112 has a liquid discharge orifice 114 that communicates with the liquid discharge passage defined by the interior surface 96 of the pump plunger center tube 92. The nozzle orifice 114 has a center axis that is coaxial with the line of movement of the pump plunger 72 as well as the center axes of the pump plunger center tube 92 and the pump chamber 14. The interior of the nozzle 112 is constructed in the same manner as known prior art nozzles to provide an off position of the nozzle on the pump plunger 72 where liquid discharge through the nozzle orifice 114 is prevented, a spray position of the nozzle where the liquid discharge is in a spray pattern, a stream position of the nozzle where the liquid discharge is in a stream pattern, and/or a foam position of the nozzle where the liquid is discharged as a foam. Nozzles of this type are known in the prior art and the nozzle 112 of the liquid dispenser can be of a known type that provides any desired combination of liquid discharge from the liquid dispenser as well as providing the off condition of the nozzle.

A bulb 120 is connected to the pump chamber 14 and the pump plunger center tube 92. The bulb 120 has a plurality of holes 122 spatially arranged around the bulb. The holes 122 receive the posts 34 on the pump chamber wall 26 in attaching the bulbs 120 to the pump chamber 14. The bulb 120 is constructed of a resilient, flexible plastic material and a cylindrical wall 124 of the bulb fits inside the interior surface of the pump chamber cylindrical wall 26.

A tubular input valve 126 is integrally formed at the distal end of the bulb cylindrical wall 124. As shown in FIG. 6, the tubular input valve 126 covers over the input port 36 of the pump chamber 14. Thus, the tubular input valve 126 controls the flow of liquid from the liquid supply passage 18 into the pump chamber 14 by flexing away from the pump chamber input port 36, and prevents the reverse flow of liquid from the pump chamber 14 to the liquid supply passage 18 by resiliently overlapping the pump chamber input port 36.

A tubular section 128 of the bulb opposite the input valve 126 extends into the pump plunger center tube 92 and engages in a tight fit against the center tube interior surface 96. The bulb tubular section 128 engaging against the pump plunger center tube interior surface 96 connects the pump plunger 72 to the dispenser housing 12 for reciprocating movement of the pump plunger relative to the dispenser housing.

A tubular output valve 132 is integrally formed on the distal end of the bulb tubular section 128. The tubular output valve 132 engages in a sealing engagement around the sealing post 98 of the pump plunger center tube 92. The tubular output valve 132 resiliently expands outwardly from the pump plunger sealing post 98 to allow a flow of liquid from the pump chamber 14 through the liquid discharge passage defined by the interior surface 96 of the pump plunger center tube, and resiliently collapses in engagement around the sealing post 98 to prevent a reverse flow of liquid.

The bulb 120 also has a vent valve 134 integrally formed on the bulb. The vent valve 134 has a configuration that causes the valve to seat against the vent chamber sealing surface 48 when the bulb 120 is in its at rest, extended position shown in FIG. 6. In this position of the vent valve 134, leakage is prevented from passing through the liquid supply passage groove 42 and the vent chamber interior passage 46. Flexing the bulb 120 into the pump chamber 14 removes the vent valve 134 from the vent chamber sealing surface 48. When the vent valve 134 is removed from the vent chamber sealing surface 48, the interior of the bottle connected to the liquid dispenser is vented through the vent chamber interior passage 46 and the liquid supply passage groove 42.

In operation of the liquid dispenser, a user grips the dispenser housing at the side wall recessed areas 64, 66 between the thumb and forefinger of the user's hand. The fingers of the user's hand are curved over the finger engagement surface 84 of the pump plunger 72. The finger engagement surface 84 can be gripped with the nozzle 112 positioned between adjacent fingers of the user's hand, or with the fingers of the user's hand engaging the finger engagement surface 84 above the nozzle 112. Squeezing the pump plunger 72 into the dispenser housing 112 causes the plunger to move along the line of movement 32 into the interior volume 52 of the dispenser housing. The movement of the pump plunger 72 into the interior of the dispenser housing 12 causes the bulb 120 to resiliently flex into the interior of the pump chamber 14. This decrease in volume of the pump chamber 14 causes the tubular input valve 126 to seat over the pump chamber input port 36 and also causes the tubular output valve 132 to flex away from the pump plunger sealing post 98 and open. Fluid in the pump chamber 14 is allowed to flow past the tubular output valve 132 and through the liquid discharge passage defined by the pump plunger center tube interior surface 96, through the liquid spinner swirl chamber 106 and then through the nozzle orifice 114. As the bulb 120 flexes into the pump chamber 14, the vent valve 134 is caused to unseat from the vent chamber sealing surface 48. This vents the interior of the bottle connected to the liquid dispenser through the liquid supply passage groove 42 and the vent chamber interior passage 46 to the exterior environment of the liquid dispenser. Releasing the user's fingers from the pump plunger 72 causes the resilience of the bulb 120 to push the pump plunger away from the pump chamber 14. This movement of the bulb 120 creates a vacuum in the pump chamber 14 that causes the tubular output valve 132 to seat around the pump plunger sealing post 98 and causes the tubular input valve 126 to separate from the pump plunger input port 36 communicating the pump chamber interior volume with the liquid supply passage 18. This causes liquid to be drawn from the container attached to the liquid dispenser up through the dip tube 44, the liquid supply passage 18, and the input port 36 into the interior of the pump chamber 14. Repeated manual squeezing of the pump plunger 72 into the dispenser housing 12 and releasing of the pump plunger 72 causing it to be moved out of the dispenser housing 12 by the resilience of the bulb 120 causes the liquid in the bottle to be pumped through the liquid dispenser and discharged from the nozzle orifice 114.

The in-line construction of the liquid dispenser enables the liquid dispenser to be constructed from a reduced number of component parts, thereby reducing the dispenser's manufacturing costs. In addition, the in-line construction provides a manually operated liquid dispenser that is easily operated by one hand of a user.

Although the liquid dispenser of the invention has been described herein by reference to a single embodiment, it should be understand that variations and alterations could be made to the construction of the liquid dispenser without departing from the scope of protection provided by the following claims.

The invention claimed is:

1. A manually operated liquid dispenser comprising:

a pump chamber having an interior volume and a cylindrical wall surrounding the interior volume, the pump chamber cylindrical wall having a center axis;

a dispenser housing having an interior volume containing the pump chamber cylindrical wall, the dispenser housing having a top wall and a pair of side walls that surround the pump chamber cylindrical wall with the entire pump chamber cylindrical wall being spaced inwardly and separated from each of the dispenser housing top wall and side walls;

a pump plunger mounted to the dispenser housing for axially reciprocating movement of the pump plunger relative to the pump chamber, the pump plunger having a liquid discharge passage that communicates with the pump chamber interior volume;

the pump plunger having a top wall and a pair of side walls that surround the liquid discharge passage, the pump plunger top wall and side walls each telescoping with the respective dispenser housing top wall and side walls in response to reciprocating movement of the pump plunger relative to the pump chamber.

2. The dispenser of claim 1, further comprising:

the dispenser housing top wall and pair of side walls surrounding a front opening of the dispenser housing; and, the pump plunger top wall and pair of side walls telescoping through the front opening of the dispenser housing.

3. A manually operated liquid dispenser comprising:

a pump chamber having an interior volume and a cylindrical wall surrounding the interior volume, the pump chamber cylindrical wall having a center axis;

a dispenser housing having an interior volume containing the pump chamber cylindrical wall, the dispenser housing having a top wall and a pair of side walls that surround the pump chamber cylindrical wall with the entire pump chamber cylindrical wall being spaced inwardly and separated from each of the dispenser housing top wall and side walls;

a pump plunger mounted to the dispenser housing for axially reciprocating movement of the pump plunger relative to the pump chamber, the pump plunger having a liquid discharge passage that communicates with the pump chamber interior volume;

the pump plunger having a center tube with the liquid discharge passage extending through the center tube; and, the pump plunger having a top wall and a pair of side walls that surround the center tube with the entire center tube being spaced inwardly and separated from each of the pump plunger top wall and side walls.

4. The dispenser of claim 3, further comprising:

the pump plunger top wall and pair of side walls telescoping with the respective top wall and pair of side walls of the dispenser housing.

5. The dispenser of claim 4, further comprising:

the pump plunger having a front wall with a finger engagement surface on the front wall, and the front wall connecting the center tube with the pump plunger top wall and side walls.

6. The dispenser of claim 5, further comprising:

the pump plunger center tube extending through the finger engagement surface.

7. A manually operated liquid dispenser comprising:

a pump chamber having an interior volume and a cylindrical wall surrounding the interior volume, the pump chamber cylindrical wall having a center axis;

a dispenser housing having an interior volume containing the pump chamber cylindrical wall, the dispenser housing having a top wall and a pair of side walls that surround the pump chamber cylindrical wall with the entire pump chamber cylindrical wall being spaced inwardly and separated from each of the dispenser housing top wall and side walls;

a pump plunger mounted to the dispenser housing for axially reciprocating movement of the pump plunger relative to the pump chamber, the pump plunger having a liquid discharge passage that communicates with the pump chamber interior volume;

the pump plunger having a center tube with the liquid discharge passage extending through the center tube;

a flexible, resilient bulb connecting the center tube to the pump chamber cylindrical wail and enclosing the interior volume of the pump chamber;

a tubular input valve integrally formed with the bulb; and, a tubular output valve integrally formed with the bulb.

8. A manually operated liquid dispenser comprising:

a pump chamber having an interior volume and a cylindrical wall surrounding the interior volume, the pump chamber cylindrical wall having a center axis;

a dispenser housing having walls surrounding an interior volume containing the pump chamber;

a pump plunger mounted to the dispenser housing for axially reciprocating movement of the pump plunger relative to the pump chamber, the pump plunger having a center tube with a liquid discharge passage extending through the center tube and communicating with the interior volume of the pump chamber, and the pump plunger having a top wall and a pair of side walls that surround the center tube with the entire center tube being spaced inwardly and separated from each of the pump plunger top wall and side walls.

9. The dispenser of claim 8, further comprising:

the pump plunger having a front wall with a finger engaging surface on the front wall, and the front wall connecting the center tube with the pump plunger top wall and side wails.

10. The dispenser of claim 9, further comprising:

the pump plunger center tube extending through the finger engagement surface.

11. The dispenser of claim 8, further comprising:

a flexible, resilient bulb connecting the center tube to the pump chamber cylindrical wall and enclosing the interior volume of the pump chamber.

12. The dispenser of claim 11, further comprising:

a tubular input valve integrally formed with the bulb; and, a tubular output valve integrally formed with the bulb.

13. The dispenser of claim 12, further comprising:

the pump plunger liquid discharge passage, the tubular input valve, the tubular output valve, and the pump chamber cylindrical wall all being coaxial.

14. The dispenser of claim 13, further comprising:

a liquid discharge orifice communicating with the liquid discharge passage, the liquid discharge orifice being coaxial with the liquid discharge passage.

15. A manually operated liquid dispenser comprising:

a pump chamber having an interior volume and a cylindrical wall surrounding the interior volume, the pump chamber cylindrical wall having a center axis;

a dispenser housing having walls surrounding an interior volume containing the pump chamber, a pump plunger mounted to the dispenser housing for axially reciprocating movement of the pump plunger relative to the pump chamber, the pump plunger having a liquid discharge passage that communicates with the pump chamber interior volume;

a flexible, resilient bulb connecting the pump plunger to the pump chamber cylindrical wall and enclosing the pump chamber interior volume, the bulb having an integral tubular output valve and an integral tubular input valve;

the pump chamber cylindrical wall having an input port; and, the bulb tubular input valve overlaying the input port.

16. The dispenser of claim 15, further comprising:

the pump plunger having a center tube with the liquid discharge passage extending through the center tube; and, the bulb tubular output valve engaging around the pump plunger center tube.

17. The dispenser of claim 15, further comprising:

the pump plunger having a liquid discharge orifice communicating with the liquid discharge passage, and the liquid discharge orifice and the pump chamber cylindrical wall being coaxial.

18. A manually operated liquid dispenser comprising:

a pump chamber having an interior volume and a cylindrical wall surrounding the interior volume, the pump chamber cylindrical wall having a center axis;

a dispenser housing having walls surrounding an interior volume containing the pump chamber, a pump plunger mounted to the dispenser housing for axially reciprocating movement of the pump plunger relative to the pump chamber, the pump plunger having a liquid discharge passage that communicates with the pump chamber interior volume;

a flexible, resilient bulb connecting the pump plunger to the pump chamber cylindrical wall and enclosing the pump chamber interior volume, the bulb having an integral tubular output valve and an integral tubular input valve;

the dispenser housing having a top wall and a pair of side walls that surround the pump chamber and the bulb; and, the pump plunger having a top wall and a pair of side walls that surround the bulb.

19. The dispenser of claim 18, further comprising:

the pump plunger top wall and pair of side walls telescoping with the respective dispenser housing top wall and pair of side walls.

* * * * *